US006062211A

United States Patent [19]

Thomas et al.

[11] Patent Number: 6,062,211

[45] **Date of Patent: *May 16, 2000**

[54] METHOD AND APPARATUS FOR PREVENTING IMPINGEMENT OF YELLOW FLAMES ON A LOG IN AN UNVENTED ARTIFICIAL GAS LOG SET

[75] Inventors: John S. Thomas, Bowling Green, Ky.; Gunther Berthold, Modena, Italy

[73] Assignees: DESA International, Inc., Bowling Green, Ky.; Worgas Bruciatori SRL, Formigine (MO), Italy

[ * ] Notice: This patent issued on a continued prosecution application filed under 37 CFR 1.53(d), and is subject to the twenty year patent term provisions of 35 U.S.C. 154(a)(2).

[21] Appl. No.: 09/018,642

[22] Filed: Feb. 4, 1998

Related U.S. Application Data

[60] Provisional application No. 60/037,097, Feb. 4, 1997.

[51] Int. Cl.[7] ..... F23C 1/18; F24C 3/04; F23Q 2/32

[52] U.S. Cl. ..... 126/512; 126/92; 126/92 R; 431/125; 431/126

[58] Field of Search ..... 126/512, 92 R, 126/92 AC, 92 B, 92; 431/125, 3, 286, 252, 126, 8, 10; 110/261, 343

[56] References Cited

U.S. PATENT DOCUMENTS

| | | | |
|---|---|---|---|
| 2,319,351 | 5/1943 | Shipley et al. | 431/286 |
| 2,952,310 | 9/1960 | Nuyl et al. | 431/8 |
| 3,302,596 | 2/1967 | Zinn | 110/261 |
| 4,572,084 | 2/1986 | Green et al. | 110/261 |
| 4,602,609 | 7/1986 | Wright | 126/92 AC |
| 4,838,240 | 6/1989 | Rieger | 431/125 |
| 4,875,464 | 10/1989 | Shimek et al. | 126/92 R |
| 4,971,030 | 11/1990 | Thow et al. | 126/512 |
| 5,000,162 | 3/1991 | Shimek et al. | 126/512 |
| 5,054,468 | 10/1991 | Moon et al. | 126/512 |
| 5,069,200 | 12/1991 | Thow et al. | 126/512 |
| 5,392,763 | 2/1995 | Shaw et al. | 126/512 |
| 5,503,550 | 4/1996 | DePalma | 126/512 |
| 5,571,008 | 11/1996 | Richardson et al. | 126/512 |
| 5,575,274 | 11/1996 | DePalma | 126/512 |
| 5,906,197 | 5/1999 | French et al. | 126/512 |

*Primary Examiner*—Ira S. Lazarus
*Assistant Examiner*—David Lee
*Attorney, Agent, or Firm*—Jones, Day, Reavis & Pogue

[57] ABSTRACT

An artificial gas log set which simulates in a very realistic fashion a log fire in a fireplace. The artificial log set comprises a log, a burner tube having ports for creating a yellow flame that is in close proximity to the log and a second set of ports for creating a blue flame which is positioned between the yellow flame and the log. The blue flame impinges on the log and acts as a separator or curtain that prevents impingement by the yellow flame on the log. This prevents the creation of unwanted and dangerous levels of emissions such as oxides of carbon and nitrogen. An alternative embodiment replaces the blue flame and its ports with duct work and exhaust gases. The exhaust gases act as a separator between the log and the yellow flame. The result is a realistic looking, simulated wood burning fireplace which may be safely used in an unvented environment.

10 Claims, 2 Drawing Sheets

METHOD AND APPARATUS FOR PREVENTING IMPINGEMENT OF YELLOW FLAMES ON A LOG IN AN UNVENTED ARTIFICIAL GAS LOG SET

RELATED APPLICATION

A provisional application, Ser. No. 60/037,097 was filed on Feb. 4, 1997.

BACKGROUND OF THE INVENTION

1. Field of the Invention

The present invention relates to an unvented, artificial log set for simulating a natural set of logs used in a fireplace and more particularly to an artificial log set where gas burner ports for issuing yellow flames are in close proximity to an artificial log set and other gas burner ports for issuing blue flames are placed between the yellow flame ports and the log set. In a variation, exhaust gases may be vented between the log set and the yellow flames to act as a separator between them.

2. Description of the Related Art

Impingement of yellow flames on any material object, including an artificial log, is to be avoided in an unvented situation to prevent an increase in undesirable emissions.

A yellow flame is relatively cool as compared to a blue flame. If a yellow flame impinges on an object like an artificial log, then it is cooled even further and less combustion takes place. This means that more unwanted and dangerous oxides of carbon and nitrogen are formed. In an unvented environment, such excessive oxides are prohibited by statute or code as a public safety measure.

It is known, however, that a close arrangement of yellow flames and artificial logs results in a more realistic looking log fire, making such an arrangement more desirable in the marketplace for unvented interior fireplaces. It is also known that blue flame impingement upon a properly designed artificial, ceramic fiber log is desirable because the surface of such a log can be made to glow red by the hotter blue flames. This red glow has proven to give an esthetically preferred appearance and it also provides radiant heat, another desirable feature in the marketplace.

Existing log sets often provide for yellow flames but these flames are too far removed from the log set to provide a sufficiently realistic impression of a natural wood log fire.

BRIEF DESCRIPTION OF THE INVENTION

The difficulties outlined above have been overcome by the present invention. What is described here is an unvented gas log system comprising a simulated log; a first conduit having a gas burner port for producing a yellow flame, the yellow flame being placed in close proximity to the log; and a second conduit having an outlet positioned to direct emanations from the second conduit between the log and the yellow flame.

The invention also includes a method for simulating a natural log fire comprising the steps of providing a simulated log set; venting gas near the log set for producing a yellow flame in proximity to the log; and forming a separation between the yellow flame and the log.

An object of the present invention is to provide an esthetically pleasing log set. Another aim of the present invention is to provide an esthetically pleasing log set which is simple, reliable and inexpensive. A further aspect of the present invention is to provide an artificial log set in an unvented environment which can closely simulate burning fireplace logs. A further advantage of the present invention is to provide a log set having a yellow flame burner port which is physically close to a log set but where the yellow flame is physically separated from the log by a blue flame or a flow of exhaust gases so that it does not impinge upon the log.

A more complete understanding of the present invention and other objects, aspects, aims and advantages thereof will be gained from a consideration of the following description of the preferred embodiments in conjunction with the accompanying drawings provided herein.

DESCRIPTION OF THE PREFERRED EMBODIMENTS

Figure 1:
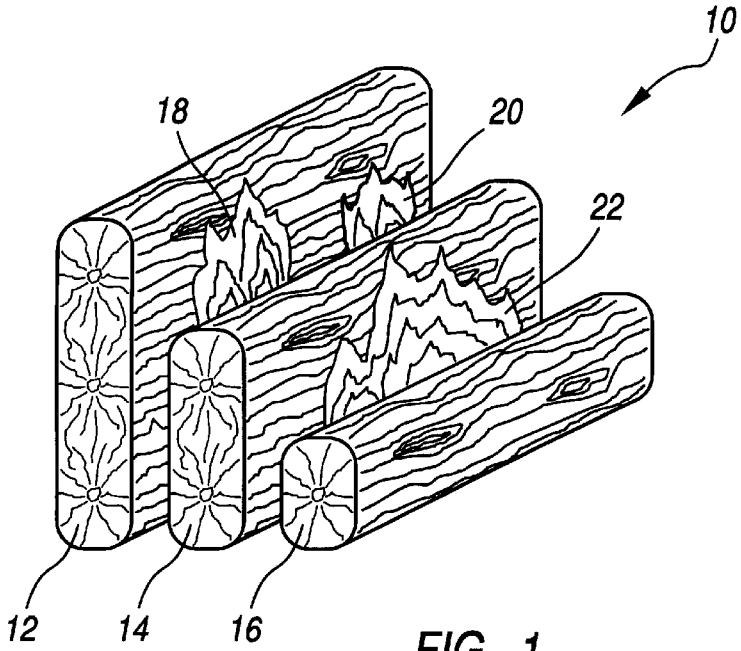
FIG. 1 is a diagrammatic perspective view of an operating log set.

While the present invention is open to various modifications and alternative constructions, the preferred embodiments shown in the drawings will be described herein in detail. It is understood, however, that there is no intention to limit the invention to the particular forms disclosed. On the contrary, the intention is to cover all modifications, equivalent structures and methods, and alternative constructions falling within the spirit and scope of the invention as expressed in the appended claims.

Referring now to FIG. 1, there is illustrated an artificial log set system 10 comprising three layers of simulated logs, a back layer 12, a middle layer 14 and a front layer 16. Gas burner ports are usually provided between layers so that fire appears between the layer 12 and the layer 14, and also between the layer 14 and the layer 16. The fire is designated by the numerals 18, 20 and 22.

Figure 2:
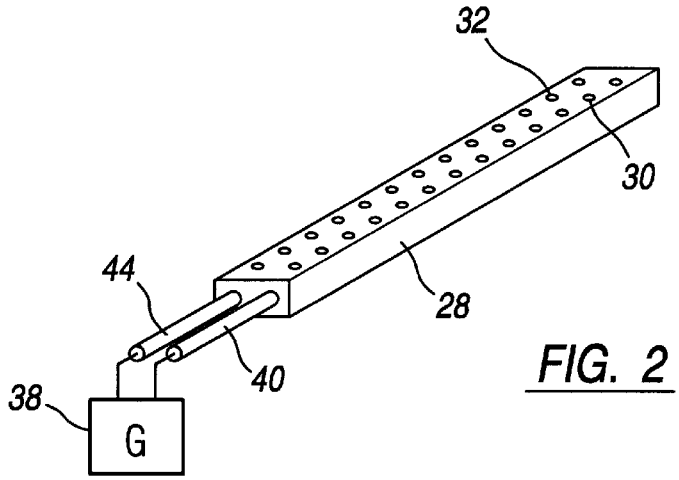
FIG. 2 is a diagrammatic perspective view of a gas burner tube having two sets of ports.
Figure 4:
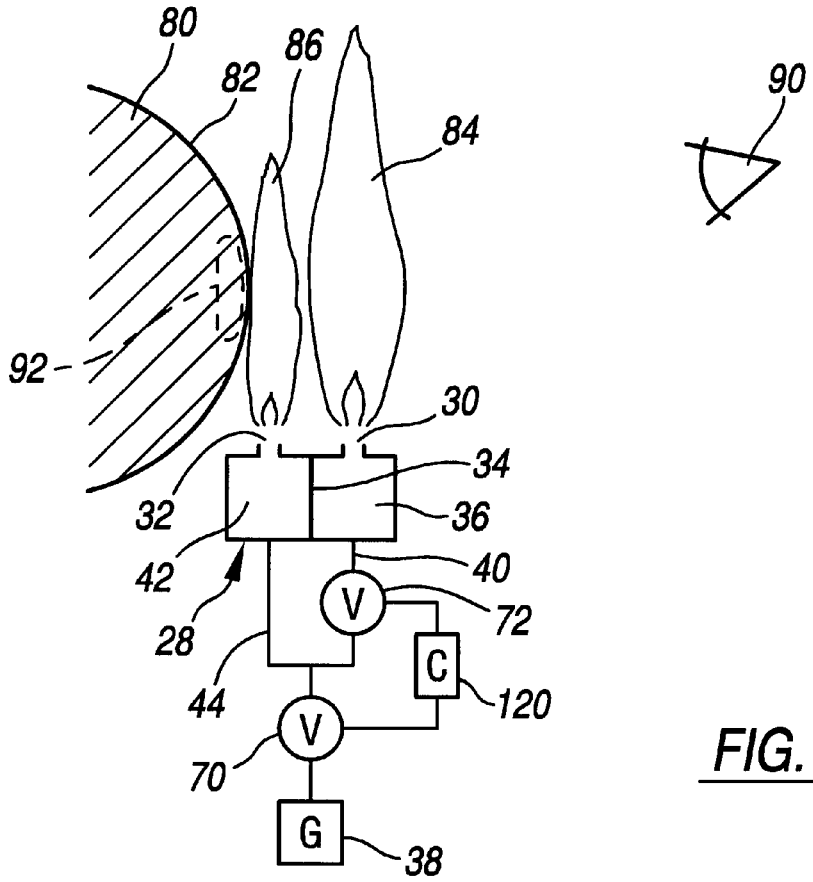
FIG. 4 is a diagrammatic elevational sectional view showing an artificial log set including a log, a blue flame, a yellow flame and a gas burner tube as shown in FIG. 2.

Referring now to FIGS. 2 and 4, there is shown a conduit in the form of a rectilinear burner tube 28 having two rows of gas burner ports or outlets in parallel alignment, a first row designated by the numeral 30 and a second row designated by the numeral 32. A wall 34 separates the two rows of ports and forms two interior chambers 36 and 42. The interior chamber 36 is associated with the gas burner ports 30 and communicates with a gas source 38 by a tube 40 in a standard fashion well known to those skilled in gas plumbing. In a like manner, the interior chamber 42 is associated with the gas burner ports 32 and is connected to the gas source 38 by a tube 44. The burner tube 28 forms two separated conduits so that gas flowing from the source 38 through the tubes 40 and 42 is directed into the chambers 36 and 42 and to the gas burner ports 30 and 32, respectively.

Figure 3:
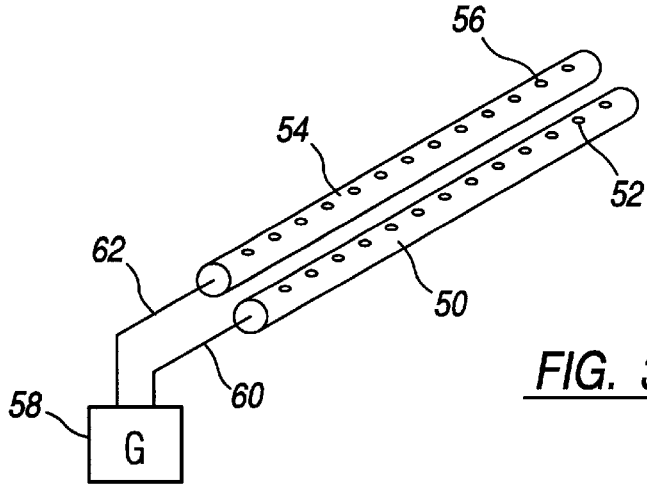
FIG. 3 is a diagrammatic perspective view of two gas burner tubes in parallel alignment with each tube having a set of ports.

A variation of the burner tube may be seen in FIG. 3 where the two sets of burner ports are physically separated and each set of ports is formed in its own cylindrical burner conduit. A first cylindrical tube 50 having a series of gas burner ports or outlets 52 is analogous to the right side of the burner tube 28 and the ports 30 while a second tube 54 having a series of burner ports or outlets 56 is analogous to the left side of the burner tube 28 and the ports 32. As with the FIG. 2 embodiment, the FIG. 3 embodiment is connected to a gas source 58 which transfers gas through delivery tubes 60 and 62.

Referring again to FIG. 4, the burner tube 28 and its associated connections are shown in more detail. The burner tube 28 is divided into the two interior chambers 36 and 42. Each of these chambers is connected by tubing to the gas source 38. Between the burner tube and the gas source is an on-off valve 70 which controls the flow of gas to the burner tube. When the valve is closed, no gas flows to the burner tube and no fire is maintained. However, when the valve is in its open mode, gas is provided for combustion. A second valve 72 may also be provided to allow the gas flow to the chamber 36 to be more closely controlled. Gas may be allowed to flow to both chambers 36 and 42 when the valve 70 is open. However, the option exists of closing the valve 72 so that gas is only being communicated to the chamber 42. The reason for this will be explained below.

The burner tube 28 is positioned adjacent an artificial ceramic fiber log 80 which has an outer surface 82. The burner tube is configured on one side so that yellow flames are provided such as a yellow flame 84. The burner tube is configured on the other side to provide blue flames such as a blue flame 86.

As can be seen, the blue flame 86 is positioned between the yellow flame 84 and the surface 82 of the log 80. This configuration has the advantage of preventing the yellow flame from impinging on the log because the blue flame acts as a barrier or separator between the log and the yellow flame. In this manner further cooling of the yellow flame is prevented and more undesirable emissions are prevented. Nevertheless, the use of the blue flame permits the yellow flame to be positioned very close to the artificial logs, closer than prior art log sets. The close proximity of the yellow flame to the artificial logs results in a far more realistic simulation of a woodburning fire when compared to prior art unvented log sets. Another advantage is that the blue flame causes a red glow of the ceramic fiber logs, a pleasing sight and a source of radiant heat.

The blue flame which is hotter and signifies more complete combustion when compared to the yellow flame impinges on the log and acts as a curtain or wall between the yellow flame and the artificial log. Thus, a viewer of such a log set, represented by an eye 90, would see the yellow flame 84, typically associated with a real wood fire and a red glow in a region 92 (in phantom line) on the ceramic fiber log caused by the blue flame. This combination, with the yellow flame being relatively close to the log but spaced by the blue flame provides a very realistic simulation to the viewer.

Figure 5:
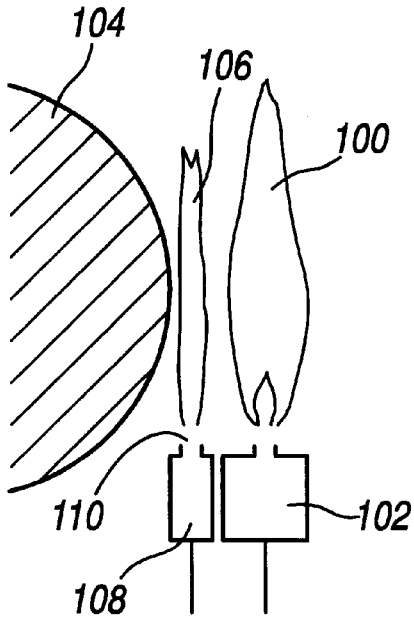
FIG. 5 is a partial diagrammatic elevational sectional view of an artificial log set system including a log, a yellow flame and exhaust gases separating the log from the flame.

Referring now to FIG. 5, a second embodiment of the invention is shown. This embodiment features a yellow flame 100, a burner tube 102 and a ceramic fiber log 104. However, instead of a blue flame between the yellow flame 100 and the log 104, exhaust gases 106 are used as a separator. Duct work 108 having an outlet 110 is provided which directs the product of combustion from a remote location to a position such that the outlet directs the exhaust gases emanating from the outlet to impinge upon the log and thus prevent any log impingement by the yellow flame. One drawback to the use of exhaust gases is that the log will not develop a red glow such as occurs with the FIG. 4 system.

It should be understood that the exhaust gases, sometimes referred to as flue gases, are the result of prior combustion at another burner tube located, typically, elsewhere in the log set. If the exhaust gases are the product of relatively complete combustion, the yellow flame will be unable to migrate because there will not be sufficient oxygen to support combustion. Thus, the exhaust gases act as a fluid curtain or barrier between the yellow flame and the log. It is an important feature of the present invention that the use of exhaust gases in the way described allows the burner tube 102 to be moved very close to the log to realistically simulate a wood fire, of course, a single exhaust gas or even an inert gas may be used instead of the exhaust gases, if desired.

The actual dimensions of the gas burner port and their locations are proportional to the BTU input of the system and the geometry of the slotted ports. For example, in a 26,000 BTU unit, the distance between the closest edges of the two rows of ports 30 and 32, FIG. 2, is about 0.23 inches. From port center line to port center line, measured from one row of ports to the other, the dimension is about 0.48 inches. The ports themselves are about 0.25 inches by about 0.017 inches.

In operation, a control 120, FIG. 4, may be used to operate the valves 70 and 72. The control may be manually operated or automatic. The control operates the valve 70 and may move the valve between open and closed positions. In the open position, gas from the gas source 38 is supplied to the burner tube 28 so as to create the outer yellow flame 84 and the inner blue flame 86. By operating the valve 72, the yellow flame may be turned on and off. Thus, the system may be operated with both flames or just the blue flame. With the valve 72 in the open position, the two flames provides maximum convection heat as well as radiant heat. In an automatic control the operation may be programed or may be thermostatically operated.

In operation, the FIG. 5 system uses exhaust gases to form a separation between the artificial log and the yellow flame 100. The exhaust or flue gases are positioned by ducts or channels 108 so as to vent between the log and the yellow flame and permits the yellow flame to be located very close to the log without impingement. The flue gases act as a barrier, curtain or wall while at the same time allowing the overall system to have a very realistic looking firewood flame.

The specification describes in detail several embodiments of the present invention. Other modifications and variations will, under the doctrine of equivalents, come within the scope of the appended claims. For example, different placement of burner tubes within multiple layers of logs, different size burner tubes as a function of BTU input, different size artificial logs, different valve locations and different materials are all considered to be equivalent structures. Still other alternatives will also be equivalent as will many new technologies. There is no desire or intention here to limit in any way the application of the doctrine of equivalents.

We claim:

1. A method for simulating a natural log fire in an unvented environment comprising the steps of:

providing a simulated log in an unvented environment;

producing a yellow flame in close proximity to said simulated log; and using a blue flame to form a separation between said yellow flame and said log and to impinge upon said log wherein said yellow flame is prevented from impingement on said log, said simulated log will glow red and provide radiant heat and more undesirable emissions are prevented.

2. A method as claimed in claim 10 including the step of:

directing gas to said yellow flame.

3. A method as claimed in claim 1 including the steps of:

directing gas to the yellow flame;

controlling said gas; and communicating gas to said blue flame.

4. An unvented gas log system comprising:

(a) a simulated log for disposition in an unvented environment;

(b) a first conduit for conveying gas located in close proximity to said simulated log, said first conduit for producing a yellow flame to help simulate a real log fire; and (c) a second conduit located between said first conduit and said simulated log for directing a blue flame between the yellow flame produced by said first conduit and said simulated log and for impinging on said log, wherein said blue flame creates a barrier to prevent said yellow flame from impingement on said simulated log, said blue flame creates a red glow on said simulated log and said blue flame prevents more undesirable emissions.

5. A system as claimed in claim 3 including:

a gas source;

a first tube for communicating said gas source and said first conduit; and a second tube for communicating said gas source and said second conduit.

6. A system as claimed in claim 3 including:

a valve connected to said first and said second conduits for controlling the flow of gas to said conduits.

7. A system as claimed in claim 6 including:

a second valve positioned between said first mentioned valve and said first conduit for controlling the flow of gas to said first conduit.

8. A system as claimed in claim 6 including:

a control connected to said valve.

9. A system as claimed in claim 7 including:

a control connected to said first mentioned and said second valves.

10. A system for reducing unwanted combustion emissions while enhancing aesthetic appearance in an unvented environment comprising:

(a) a tangible object disposed in said unvented environment;

(b) means for creating a yellow flame disposed in close proximity to said tangible object; and (c) means for creating a blue flame positioned between the yellow flame from said yellow flame creating means and said tangible object wherein the blue flame is a barrier to prevent the yellow flame from impingement on said tangible object, said blue flame creates a red glow on said tangible object and said blue flame prevents more undesirable emissions.

* * * * *

UNITED STATES PATENT AND TRADEMARK OFFICE

CERTIFICATE OF CORRECTION

PATENT NO. : 6,062,211
DATED : May 16, 2000
INVENTOR(S) : John S. Thomas et al.

It is certified that error appears in the above-identified patent and that said Letters Patent is hereby corrected as shown below:

Column 5,
Line 3, change “10” to -- 1 --.
Line 25, change “3” to -- 4 --.

Column 6,
Line 1, change “3” to -- 4 --.

Signed and Sealed this

Twenty-seventh Day of August, 2002

*Attest:*

*Attesting Officer*

JAMES E. ROGAN
*Director of the United States Patent and Trademark Office*